US012497709B2

(12) United States Patent
Cummings et al.

(10) Patent No.: US 12,497,709 B2
(45) Date of Patent: Dec. 16, 2025

(54) WEAR RESISTANT COMPONENT AND PROCESS THEREFOR

(71) Applicant: HAMILTON SUNDSTRAND CORPORATION, Charlotte, NC (US)

(72) Inventors: Paul Cummings, Sycamore, IL (US); Lei Chen, South Windsor, CT (US); Brodie Gross, Janesville, WI (US); Jordan Pugliese, Woodstock, IL (US); Eric Karlen, Rockford, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 3 days.

(21) Appl. No.: 18/600,955

(22) Filed: Mar. 11, 2024

(65) Prior Publication Data

US 2025/0283240 A1 Sep. 11, 2025

(51) Int. Cl.

| | |
|---|---|
| ***C25D 11/02*** | (2006.01) |
| ***C23C 28/00*** | (2006.01) |
| ***C25D 11/16*** | (2006.01) |
| ***C25D 11/24*** | (2006.01) |

(52) U.S. Cl.

CPC ..... *C25D 11/026* (2013.01); *C23C 28/322* (2013.01); *C23C 28/345* (2013.01); *C25D 11/16* (2013.01); *C25D 11/246* (2013.01)

(58) Field of Classification Search

CPC ..... C25D 11/026

See application file for complete search history.

(56) References Cited

U.S. PATENT DOCUMENTS

| | | | | |
|---|---|---|---|---|
| 7,967,055 | B2 | 6/2011 | Parkos, Jr. et al. | |
| 8,877,031 | B2 | 11/2014 | Suda et al. | |
| 10,077,717 | B2 | 9/2018 | Shmyreva et al. | |
| 11,001,927 | B2 | 5/2021 | Raga et al. | |
| 11,313,047 | B2 | 4/2022 | Gurt Santanach et al. | |
| 2016/0153112 | A1* | 6/2016 | Durán | C25D 11/26 205/188 |
| 2016/0348261 | A1 | 12/2016 | Klauke | |

(Continued)

FOREIGN PATENT DOCUMENTS

| | | | |
|---|---|---|---|
| CN | 106702330 | 5/2017 | |
| CN | 108796569 A * | 11/2018 | C25D 11/026 |

(Continued)

OTHER PUBLICATIONS

Machine translation of Abstract of CN108796569A of Gao et al. (Year: 2018).*

*Primary Examiner* — Brian W Cohen

(74) *Attorney, Agent, or Firm* — Carlson, Gaskey & Olds, P.C.

(57) ABSTRACT

A method for providing a wear-resistant component includes depositing an aluminum coating on a steel component to provide an aluminum-coated steel component, and subjecting the aluminum-coated steel component to a plasma electrolytic oxidation (PEO) process. The PEO process converts a surface portion of the aluminum coating to alumina. A wear-resistant component includes a steel component and a wear-resistant coating on the steel component. The wear-resistant coating includes an alumina surface portion and an underlying portion of either aluminum or aluminum and nickel combination or nickel aluminide that contacts the steel component.

9 Claims, 1 Drawing Sheet

(56) References Cited

U.S. PATENT DOCUMENTS

| | | | | |
|---|---|---|---|---|
| 2017/0114471 | A1 | 4/2017 | Rice et al. | |
| 2018/0216524 | A1* | 8/2018 | Lineton | F01L 3/04 |
| 2020/0071845 | A1* | 3/2020 | Zhang | C25D 11/026 |

FOREIGN PATENT DOCUMENTS

| | | |
|---|---|---|
| DE | 102015212330 | 1/2017 |
| FR | 3031989 | 11/2020 |

* cited by examiner

WEAR RESISTANT COMPONENT AND PROCESS THEREFOR

BACKGROUND

Rotating steel components are subject to wear against mating components. In order to mitigate wear, a hard wear-resistant chrome is often applied to the steel component. The hard chromium is deposited in an electrolytic plating process and involves chemicals (chromic acid) that contain hexavalent chromium. Hexavalent chromium is a known carcinogen, and use of it in the plating process thus requires stringent environmental control and compliance with related regulations. Increasing costs and regulation pressure make hard chrome plating less and less favorable. There has thus been a desire to replace hard chrome with a wear resistant coating that can be manufactured using benign processes and chemicals. However, finding a universally suitable replacement has proven challenging. One replacement electroplating method uses trivalent chrome chemicals instead of chromic acid. Properties of the hard coatings made in a trivalent chrome bath have not matched up those of the incumbent. Electroplated nickel or cobalt alloys are among most promising alternatives. Thermal spray such as HVOF and plasma spray can produce hard coating such as tungsten carbide (WC). A common requirement for these alternative coatings is post machining to attain dimensional conformance. Machining, especially grinding, a hard coating can be difficult as the desired properties of the coating is not amicable to many machining methods, leading to additional costs and sometimes product fall-out. Furthermore, hydrogen embrittlement risk on steel substrates during the electrolytic processes needs to be mitigated by a post-bake process.

SUMMARY

A method according to an example of the present disclosure includes depositing an aluminum coating on a steel component to provide an aluminum-coated steel component, and subjecting the aluminum-coated steel component to a plasma electrolytic oxidation (PEO) process, the PEO process converting a surface portion of the aluminum coating to alumina.

In a further embodiment of any of the foregoing embodiments, an underlying portion of the aluminum coating that contacts the steel component remains as aluminum after the PEO process.

In a further embodiment of any of the foregoing embodiments, the depositing is conducted by at least one of physical vapor deposition, cold spray, friction stir manufacturing, thermal packing aluminizing, or electrodeposition in a non-aqueous solution.

A further embodiment of any of the foregoing embodiments includes, prior to the depositing, degreasing and etching a surface of the steel component onto which the aluminum coating is to be deposited.

A further embodiment of any of the foregoing embodiments includes, after the depositing and before the PEO process, machining the aluminum coating to a desired coating thickness of 10 to 100 micrometers and a surface finish of Ra 4 to 50.

A further embodiment of any of the foregoing embodiments includes, sealing the alumina with a sealant to prevent corrosion, including impregnating the alumina with PTFE or non-chromate corrosion inhibitors.

A further embodiment of any of the foregoing embodiments includes, applying a lubricious material to the alumina.

In a further embodiment of any of the foregoing embodiments, the steel component is a shaft.

A wear-resistant component according to an example of the present disclosure includes a steel component, and a wear-resistant coating on the steel component. The wear-resistant coating includes an alumina surface portion and an underlying portion of either aluminum or aluminum and nickel combination or nickel aluminide that contacts the steel component.

In a further embodiment of any of the foregoing embodiments, the underlying portion is the aluminum and nickel combination.

In a further embodiment of any of the foregoing embodiments, the underlying portion is the nickel aluminide, and there is an intermediate zone of aluminum between the alumina surface portion and the underlying portion of nickel aluminide.

In a further embodiment of any of the foregoing embodiments, the wear-resistant coating includes a lubricious material.

In a further embodiment of any of the foregoing embodiments, the steel component is a shaft.

A method according to an example of the present disclosure includes depositing a nickel coating onto a steel component, depositing an aluminum coating onto the nickel coating to provide an aluminum-nickel-coated steel component, and heat-treating the aluminum-nickel-coated steel component to form a diffusion zone of nickel aluminide. An overlying portion of the aluminum coating remains as aluminum after the heat-treating. The aluminum-nickel-coated steel component is then subjected to a plasma electrolytic oxidation (PEO) process. The PEO process converts a surface portion of the overlying portion of the aluminum coating to alumina. An underlying portion of the aluminum coating remains as aluminum after the PEO process.

In a further embodiment of any of the foregoing embodiments, the heat-treating is conducted in a protective atmosphere of argon, nitrogen or vacuum in a temperature range of 500° C. to 800° C.

A further embodiment of any of the foregoing embodiments includes a machining process to attain a surface finishing of Ra 4 to 50 after the heat treatment prior to the PEO process.

The present disclosure may include any one or more of the individual features disclosed above and/or below alone or in any combination thereof.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

A method is disclosed for providing a hard, wear-resistant coating on a steel component. Various types of hard coatings are known. However, high performance components such as shafts in turbomachinery, also require durability, i.e., the coating must be strongly adhered to the component. In this regard, the disclosed method and wear-resistant coating are designed for strong adherence and good durability.

Figure 1:
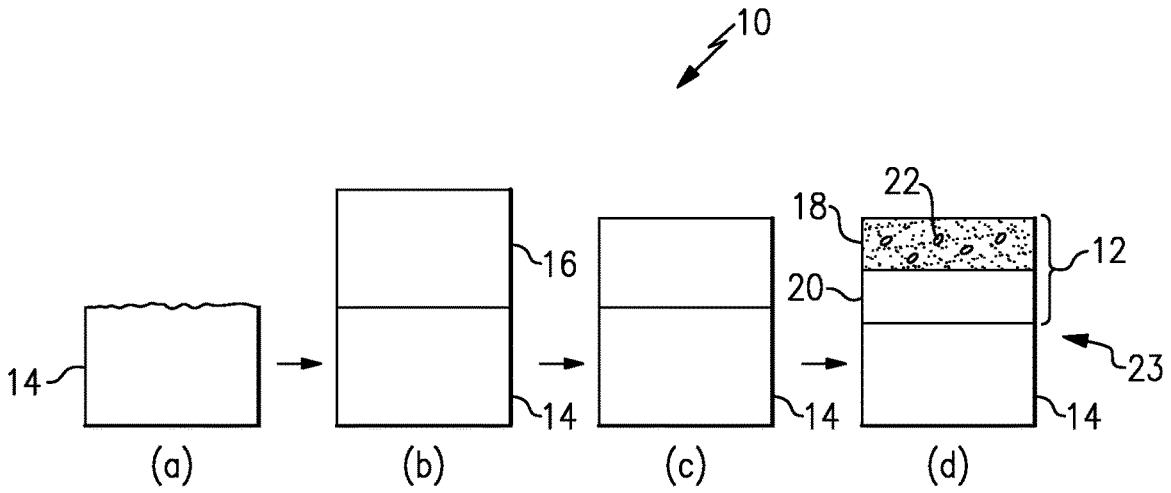
FIG. 1 illustrates a method for providing a wear-resistant component including an aluminizing process and subsequent plasma electrolytic oxidation.

FIG. 1 depicts an example method 10 for providing a wear-resistant coating 12 on a steel component 14. As will be appreciated, the steel component 14 is not particularly limited and may be a shaft, for example. Moreover, the method 10 may be used with various types of steels, but may be especially beneficial to those steels that are used in high performance components. Initially, at step (a), the steel component 14 is provided and the surface of the steel is pre-treated. For instance, the steel component 14 is subjected to a degreasing process and an etching process, such as with a chemical etchant. The degreasing removes oils and other foreign substances that may be present on the surface from prior fabrication processes, such as processes used to form the steel component 14. The etching further prepares the surface by removing oxides that might inhibit bonding, as well as creating a surface roughness conducive to strong mechanical bonding.

Next, at step (b), an aluminum coating 16, which may be pure aluminum or an aluminum alloy, is deposited onto the steel component 14 to provide an aluminum-coated steel component. As an example, the aluminum is deposited by at least one of physical vapor deposition, cold spray, friction stir manufacturing, thermal packing aluminizing, or electrodeposition in a non-aqueous solution (so as to avoid introducing hydrogen). At this stage the aluminum is substantially in metallic form and may be pure aluminum or an aluminum alloy. The aluminum coating 16 is strongly bonded to the steel component 14. Optionally, at step (c), the aluminum coating 16 is machined to a desired coating thickness and surface roughness in the range of Ra 4 to 50, such as 4 to 10. For instance, the aluminum or its alloy is far softer than the ceramic coating to be converted to, and it is thus easier to machine and polish the aluminum coating to the desired dimensions and surface finish than the conventional post-machining performed on other hard coatings.

Next, at step (d), the aluminum-coated steel component from step (c) is subjected to a plasma electrolytic oxidation (PEO) process. The PEO process converts a surface portion 18 of the aluminum coating to alumina, such as alpha and gamma alumina. The PEO process can be performed to convert a portion 18 of the coating to alumina, while an underlying portion 20 of the aluminum coating that contacts the steel component 14 remains as aluminum metal after the PEO process. The underlying portion 20 (underlayer) strongly adheres the wear-resistant coating 12 to the steel component 12, thereby facilitating greater durability against spalling. Unlike through cracks in typical electrolytic hard chrome coating, the micro-pores in the PEO coating can be sealed to provide better corrosion protection of the substrate. For example, in a further step, the alumina is sealed with a sealant to prevent corrosion, by impregnating the alumina with PTFE or non-chromate corrosion inhibitors. Furthermore, the aluminum alloy underlayer is substantially corrosion resistant by the choice of pure aluminum or aluminum alloys in the aluminizing operation, provide more robust corrosion protection of the substrate. Additionally, as the aluminum is soft in comparison to the alumina and the steel, the underlying portion 20 can also serve to arrest cracks that might otherwise propagate from the alumina into the steel.

PEO, also known electrolytic plasma oxidation (EPO) or microarc oxidation (MAO), is an electrochemical surface treatment process for generating oxide coatings. It employs high DC or pulsed voltage to induce plasma discharges at the part and electrolyte interface, producing mixed oxides comprising crystalline and amorphous alumina. In PEO, the aluminum-coated steel component is immersed in a bath of alkaline electrolyte solution The component is electrically connected, so as to become one of the electrodes in the electrochemical cell, with the other counter-electrode typically being made from an inert material such as stainless steels. Potentials of over 200V are applied between the two electrodes. The potential may be continuous or pulsed. The voltage and time can be varied in order to control the thickness of the resulting alumina surface portion 18. The method 10 results in fabrication of a wear-resistant component 23.

Optionally, a lubricious material 22 may be applied to the alumina to enhance lubricity of the coating 12. A lubricious material is a material that has a lubricity that is greater than the lubricity of alumina (where lubricity is inversely proportional to the coefficient of friction of the material, i.e., a high lubricity has a low coefficient of friction). For example, additives can be used in the solution of the PEO process to modify the alumina surface portion 18 as it forms. A lubricious material, such as molybdenum sulfide, can be included in the solution and incorporated into the alumina to enhance lubricity. Additionally or alternatively, a lubricious material can be applied to the alumina surface portion after the PEO process, such as polytetrafluoroethylene.

Figure 2:
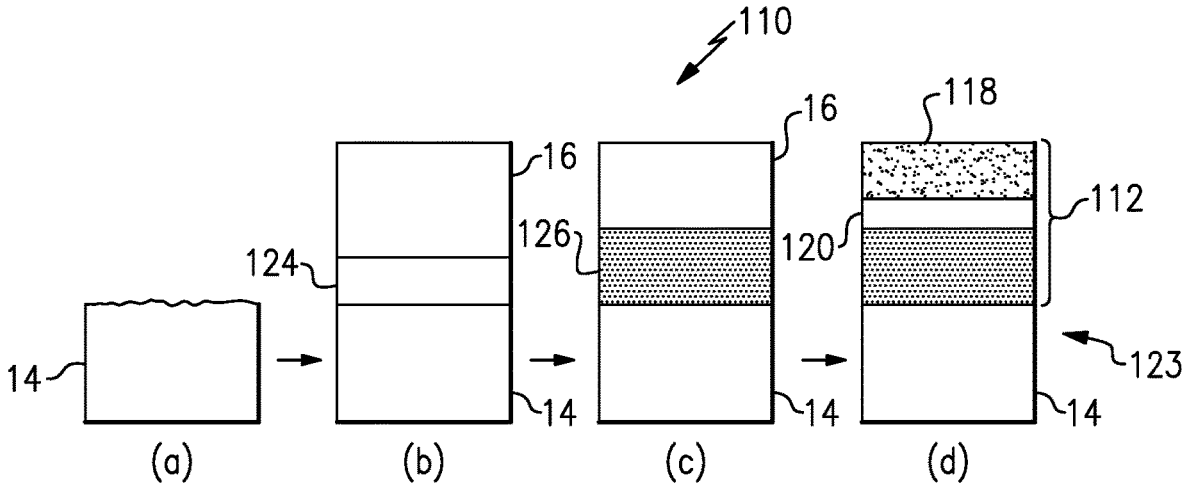
FIG. 2 illustrates another method for providing a wear-resistant component including a nickel strike layer, aluminizing, diffusion treatment, and finally a plasma electrolytic oxidation process In this disclosure, like reference numerals designate like elements where appropriate and reference numerals with the addition of one-hundred or multiples thereof designate modified elements that are understood to incorporate the same features and benefits of the corresponding elements. Terms such as "first" and "second" used herein are to differentiate that there are two architecturally distinct components or features. Furthermore, the terms "first" and "second" are interchangeable in that a first component or feature could alternatively be termed as the second component or feature, and vice versa.

FIG. 2 depicts a further example of a method 110 that is similar to the method 10, except that prior to the depositing of the aluminum coating 16, a nickel coating 124 is deposited onto the steel component 12. Step (a) is the same as above. The nickel coating 124 may be deposited using any of the same techniques as used for depositing the aluminum coating 16. For example, the nickel coating can be deposited by electroplating to form an extremely thin layer of nickel strike to minimize internal stress. The aluminum coating 16 is then deposited at step (b) onto the nickel coating 16 to provide an aluminum-nickel-coated steel component.

Next, at step (c), the aluminum-nickel-coated steel component is heat treated to convert the nickel coating 124 and a portion of the aluminum coating 16 to a nickel aluminide zone 126. For example, the heat-treating is conducted in a protective atmosphere of nitrogen, argon or vacuum to prevent thermal oxidation of the aluminum layer and in a temperature range of 500° C. to 800° C. The temperature and time of the heat treatment may be selected to maintain the mechanical strength of the base alloy. Specifically, the heat treatment for aluminizing is performed in a. The nickel content in the diffusion zone ranges 5% to 90% atomic ratio. An overlying portion of the aluminum coating remains as aluminum after the heat treatment. Subsequently, in step (d), the PEO process converts a surface portion 118 of the aluminum coating into alumina, while an intermediate zone of aluminum 120 remains between the alumina surface portion 118 and the underlying nickel aluminide zone 126. The nickel aluminide zone 126 and the aluminum portion 120 strongly adhere the wear-resistant coating 112 to the steel component 12, thereby facilitating greater durability against spalling and serving to arrest through cracks that can compromise fatigue capability of the component. The method 110 results in fabrication of a wear-resistant component 123.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A method comprising:

depositing a nickel coating onto a steel component;

depositing an aluminum coating onto the nickel coating to provide an aluminum-nickel-coated steel component;

heat-treating the aluminum-nickel-coated steel component to form a diffusion zone of nickel aluminide, an overlying portion of the aluminum coating remaining as aluminum after the heat-treating; and subjecting the aluminum-nickel-coated steel component to a plasma electrolytic oxidation (PEO) process, the PEO process converting a surface portion of the overlying portion of the aluminum coating to alumina, an underlying portion of the aluminum coating remaining as aluminum after the PEO process.

2. The method as recited in claim 1, wherein the heat-treating is conducted in a protective atmosphere of argon, nitrogen or vacuum in a temperature range of 500° C. to 800° C.

3. The method as recited in claim 1 further comprising a machining process to attain a surface finishing of Ra 4 to 50 after the heat treatment prior to the PEO process.

4. The method as recited in claim 1, wherein the depositing of at least one of the aluminum coating or the nickel coating is conducted by at least one of physical vapor deposition, cold spray, friction stir manufacturing, thermal packing aluminizing, or electrodeposition in a non-aqueous solution.

5. The method as recited in claim 1, further comprising, prior to the depositing the nickel coating, degreasing and etching a surface of the steel component onto which the aluminum coating is to be deposited.

6. The method as recited in claim 1, further comprising, after the depositing the aluminum coating and before the PEO process, machining the aluminum coating to a desired coating thickness of 10 to 100 micrometers and a surface finish of Ra 4 to 50.

7. The method as recited in claim 1, further comprising sealing the alumina with a sealant to prevent corrosion, including impregnating the alumina with PTFE or non-chromate corrosion inhibitors.

8. The method as recited in claim 1, further comprising applying a lubricious material to the alumina.

9. The method as recited in claim 1, wherein the steel component is a shaft.

* * * * *